US006704979B1

(12) United States Patent
de Riz et al.

(10) Patent No.: US 6,704,979 B1
(45) Date of Patent: Mar. 16, 2004

(54) METHOD FOR PRODUCING ELASTIC BANDS FOR THE CLOTHING INDUSTRY

(75) Inventors: Erich de Riz, Laudenbach (DE); Robert Devos, Maarkedal (BE); Ingeborg Schuster, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 127 days.

(21) Appl. No.: 10/030,553

(22) PCT Filed: Jul. 5, 2000

(86) PCT No.: PCT/EP00/06311

§ 371 (c)(1),
(2), (4) Date: Apr. 30, 2002

(87) PCT Pub. No.: WO01/02636

PCT Pub. Date: Jan. 11, 2001

(30) Foreign Application Priority Data

Jul. 6, 1999 (DE) ..... 199 30 917

(51) Int. Cl.[7] ..... D06H 7/12
(52) U.S. Cl. ..... 28/157; 28/155
(58) Field of Search ..... 28/155, 157, 140, 28/142, 143, 153, 165, 170, 100, 299; 2/243.1; 26/7, 82; 112/402, 413, 440, 441, 475.08, 147, 475.06; 156/137, 148, 149, 200, 204, 217, 218; 83/14, 23, 39, 42, 43, 44, 45, 46, 48, 54

(56) References Cited

U.S. PATENT DOCUMENTS

| | | | | | |
|---|---|---|---|---|---|
| 893,356 | A | * | 7/1908 | Nelke | 28/157 |
| 1,607,266 | A | * | 11/1926 | Lough | 28/157 |
| 1,615,517 | A | * | 1/1927 | Mundorf | 28/170 |
| 2,928,160 | A | * | 3/1960 | Mayer | 28/157 |
| 2,987,796 | A | * | 6/1961 | Evans et al. | 28/157 |
| 3,557,268 | A | | 1/1971 | Beretta et al. | |
| 5,189,769 | A | * | 3/1993 | Shoesmith | 28/157 |

FOREIGN PATENT DOCUMENTS

| | | |
|---|---|---|
| DE | 1 504 704 | 9/1969 |
| DE | 34 01 532 | 8/1985 |
| FR | 2 045 316 | 2/1971 |
| GB | 1 448 601 | 9/1976 |
| JP | 61-41357 | 2/1986 |
| JP | 63-159565 | 7/1988 |
| JP | 2-300366 | 12/1990 |
| JP | 5-93363 | 4/1993 |
| JP | 6-234300 | 8/1994 |
| JP | 8-156947 | 6/1996 |

* cited by examiner

*Primary Examiner*—A. Vanatta
(74) *Attorney, Agent, or Firm*—Kenyon & Kenyon

(57) ABSTRACT

Method for producing elastic tapes from a fabric web having at least partially synthetic fibers or filaments, especially a nonwoven fabric web, for use in the garment industry, one or a plurality of industrially produced webs (1, 2; 16) being laid on top of one another and at their open edges (3, 4; 5, 6; 18, 19) being joined to one another and a tube (11) being formed; and wall (21) of the tube (11) is cut open slantwise, so that a new, more elastic fabric web (22) is created, which is cut to tapes (25) in the longitudinal direction (26).

9 Claims, 6 Drawing Sheets

METHOD FOR PRODUCING ELASTIC BANDS FOR THE CLOTHING INDUSTRY

BACKGROUND INFORMATION

TECHNICAL FIELD

Figure 1:
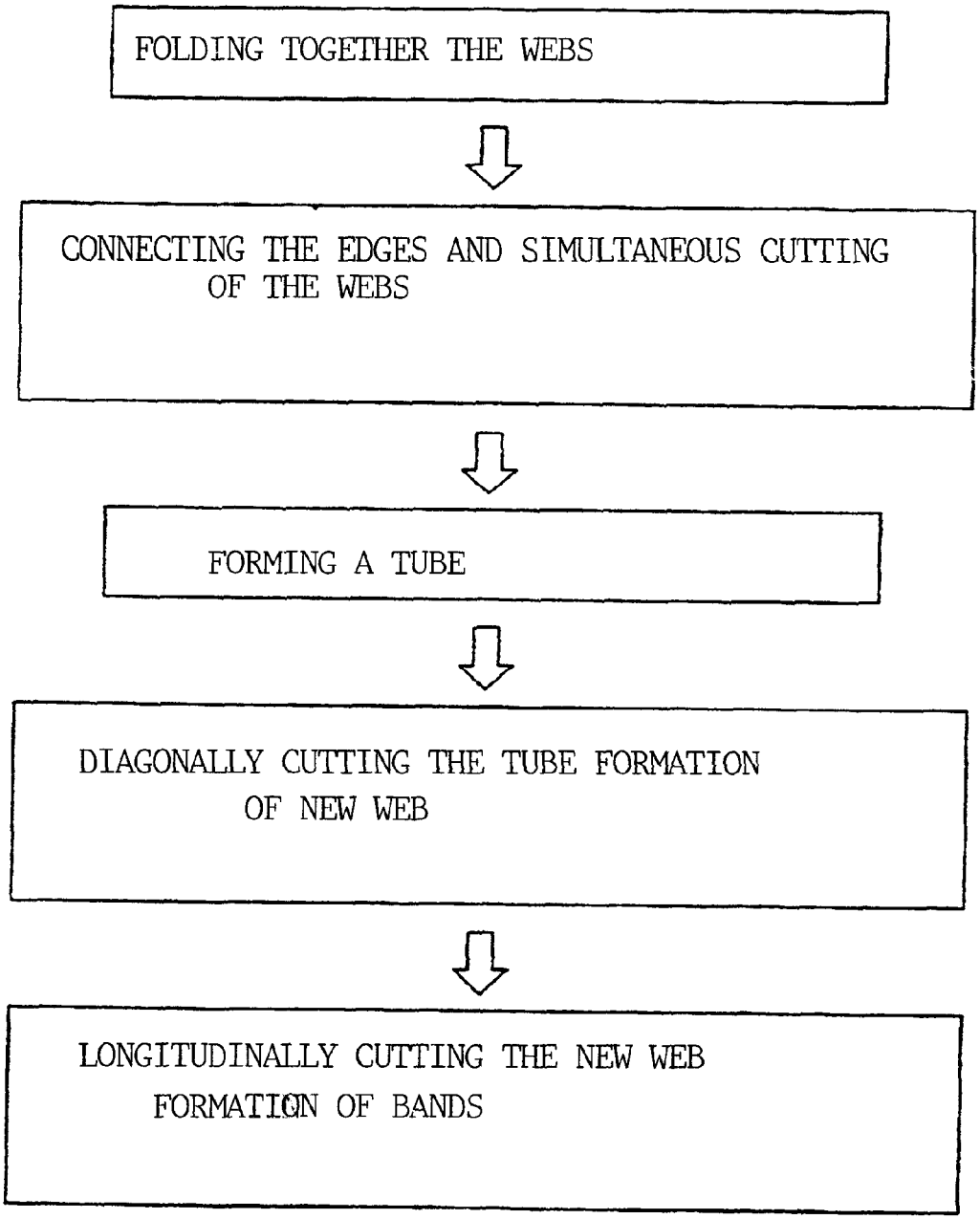

The present invention relates to a method for producing elastic and stretchable tapes from an interlining fabric web made from a nonwoven fabric web for use in the garment industry.

The garment industry has a requirement, for manifold purposes, such as interlining for suits, jackets, blouses and the like, for tapes which, joined together with the clothing material, gives the latter great stability and elasticity at the same time. It is intended thereby to have the tapes impart increased strength to the material in a predefined direction. It is also the purpose to maintain, or rather stabilize the shaping. The use of tapes, which, for example, in the longitudinal direction have great stability, but which have reduced strength in the transverse direction, is in many cases not desirable. However, this type of strength is obtainable with tapes cut from interlining fabric webs because an interlining fabric web, either from a weaving process or from the production of nonwoven fabric webs often has a greater strength in the longitudinal than in the transverse direction, or directions in between.

Therefore it is the object of the present invention to create a method with which tapes can be produced which have great strength, but at the same time, in a predefined direction of the interlining fabric web have flexibility and strength that are as equal as possible.

The set object is attained, according to the present invention, by a method of the generic concept named at the beginning, in that one or several industrially produced interlining fabric webs is/are laid together and joined at their open edges, and a tube is formed, and the wall of the tube is cut open at an angle, thus creating a new interlining fabric web more elastic in the longitudinal and the transverse direction, furnished with the same strength, which is then cut to tapes in the longitudinal direction. By this procedure, the directions of the warp and the weft threads in a web are changed, and in a nonwoven fabric, the main directions of the fibers or filaments, as the case may be. The original alignment of the warp threads in the longitudinal direction of the interlining fabric web, or the fibers and filaments in the case of a nonwoven fabric web is changed, and in the new interlining fabric web it lies slantwise to its longitudinal direction. Then, in the case of the tapes cut from the interlining fabric web, the warp and the weft threads or the fibers and filaments, respectively, in the case of a nonwoven fabric, as a result, also lie slantwise to the longitudinal direction of the tapes.

To produce the new interlining fabric web from which the tapes are to be cut, two interlining fabric webs of equal width can be laid on top of each other and their open edges joined to each other. This procedure is very simple from a machine-working point of view. However, one can also just use just one nonwoven fabric web, halve it in the longitudinal direction, lay one side over the other and also join the open edges, so as to form a tube. Whereas for the first possibility, the open edges have to be joined on both sides of the interlining fabric web, and as a result, two devices have to be used, for the second named possibility only one device is needed for joining the open edges.

Various possibilities are conceivable for joining the open edges. However, joining the edges by an ultrasound or a laser beam technique is especially preferred. This has several advantages compared to joining with a seam, by sewing with a machine. Thus, a seaming is formed which has great strength. Comparative tearing tests have shown that a seaming produced by the ultrasound method has greater strength than the adjacent fabric web, i.e. during tensile strength tests, the fabric web tears, and not the seaming. In the case of a sewed seam this is different, in that the seam tears but the fabric web maintains itself. This can also be understood from the fact that, when the tube is cut, the joining thread is cut up. Another advantage is that the seaming is just about invisible, or rather, it can be designed to be just about invisible. So as to make the seaming as little apparent as possible, it is expedient to cut off the seam allowance of the fabric web which projects beyond the joining line. In the case of a sewed seam this can be done to only a limited extent. Therefore, the sewed edge becomes visible in the finished tape. In many cases, this seam can have an unfavorable effect during the further processing of the tape, and it is necessary to cut off the seam locations from the tape, which means many clippings [much waste]. In contrast, when joining by ultrasound or laser beam technique, the seam allowance can be fully cut off, or but for a minimum amount, right up to the seaming created by the ultrasound, and when the new interlining fabric web is spread out, the joining location is as good as invisible. A considerable quantity of web material can be saved in the production of the tube as well as during later processing. Cutting out the seam portions from the finished tape is no longer necessary. The cutting angle at which the tube is cut open, which lies between a line transverse to the fabric web and the cutting line is determined by the use to which the tape will be put. It is favorably set at 8, 12 or 38°. The greater the cutting angle, the greater is the elasticity of the new interlining fabric web in the case of nonwoven fabric webs, and thus, of the tapes produced from it.

The tapes thus produced, after final processing, are used at the most varied places in articles of clothing. Because of this, it may be necessary to make them up as well. For example, this can be done by providing the cut tapes with a seam, using a lockstitch, chain stitch or blind stitch. It is also possible, and done a lot in practice, that several of the cut tapes are joined to one another using a lockstitch, chain stitch or blind stitch.

The method according to the present invention is particularly suitable for producing tapes cut from a nonwoven fabric web. In this case, preferably nonwoven fabric webs are used whose fibers and/or filaments are predominantly aligned in the longitudinal direction of the nonwoven fabric web. By the formation of a tube from such nonwoven fabric webs, their being cut open and the construction of the new nonwoven fabric web, a slantwise alignment of the main fiber direction is achieved which leads to the desired properties in the tapes cut from the new nonwoven fabric web.

The present invention is explained in greater detail with the aid of the exemplary embodiments represented in the drawings.

Figure 2:
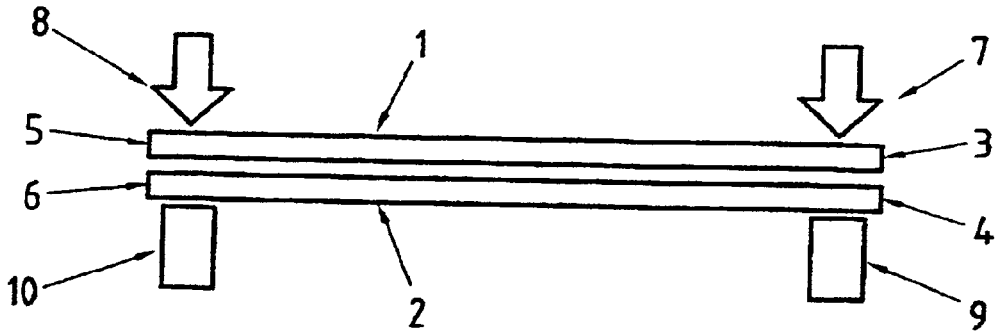
Figure 3:
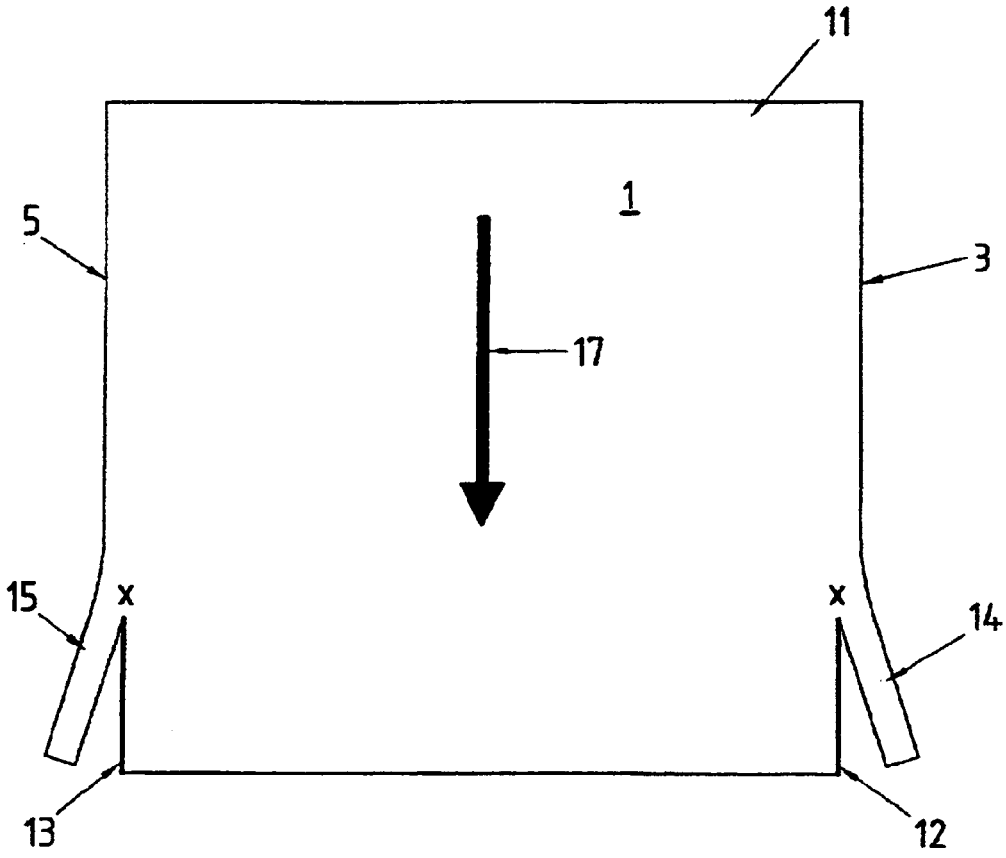
Figure 4:
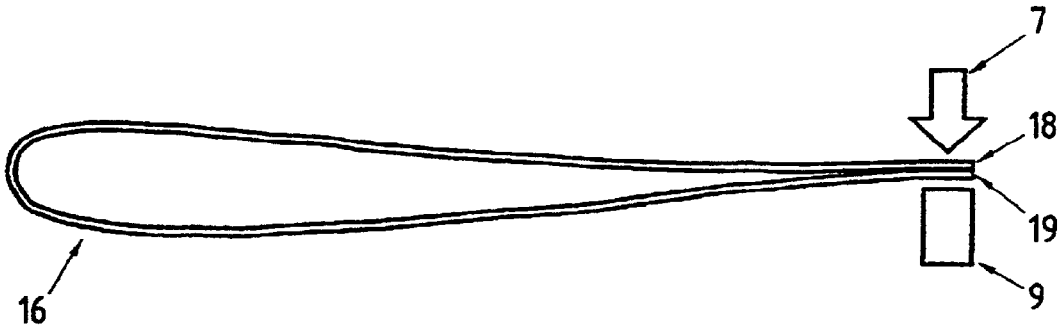
Figure 5:
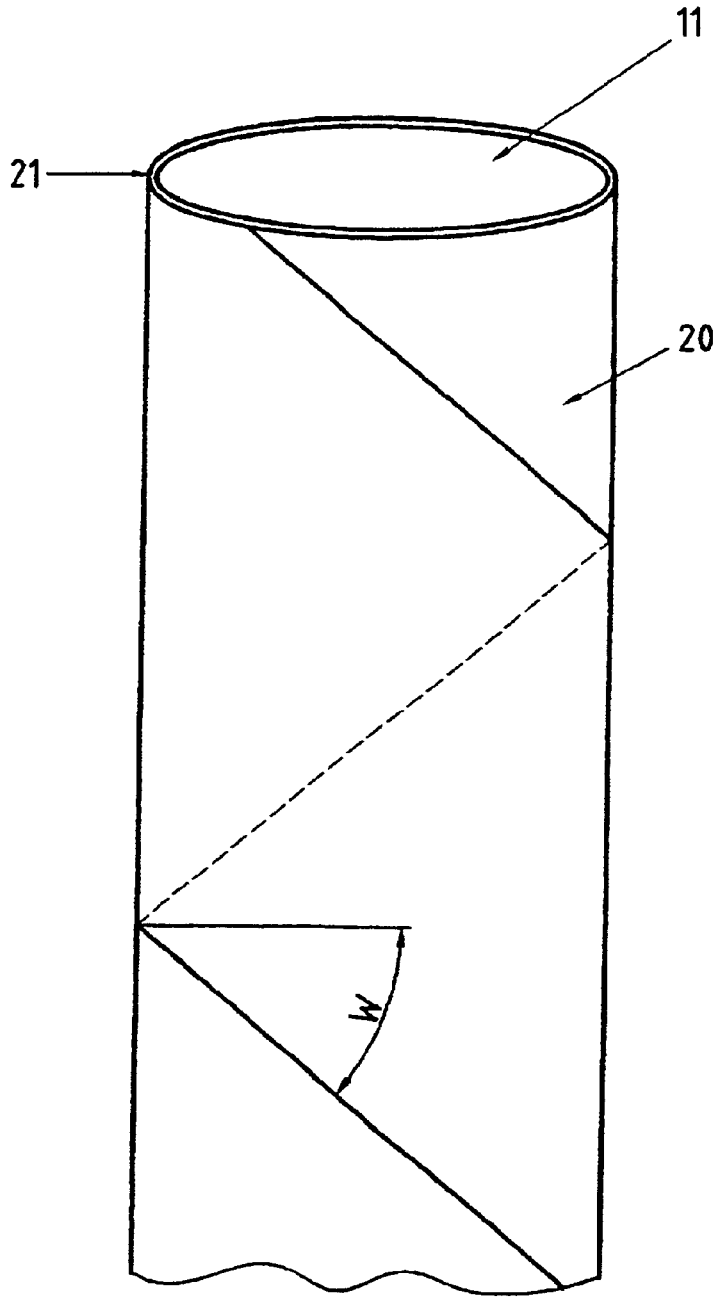

The Figures show:

FIG. 1 a schematic flow of the method,

FIG. 2 a schematic and coarsened section of the production of the tube from two fabric webs, FIG. 3 a top view of the fabric webs as in FIG. 2, FIG. 4 a schematic of the formation of a tube from a fabric web;

FIG. 5 a tube having a cutting line indicated and

Figure 6:
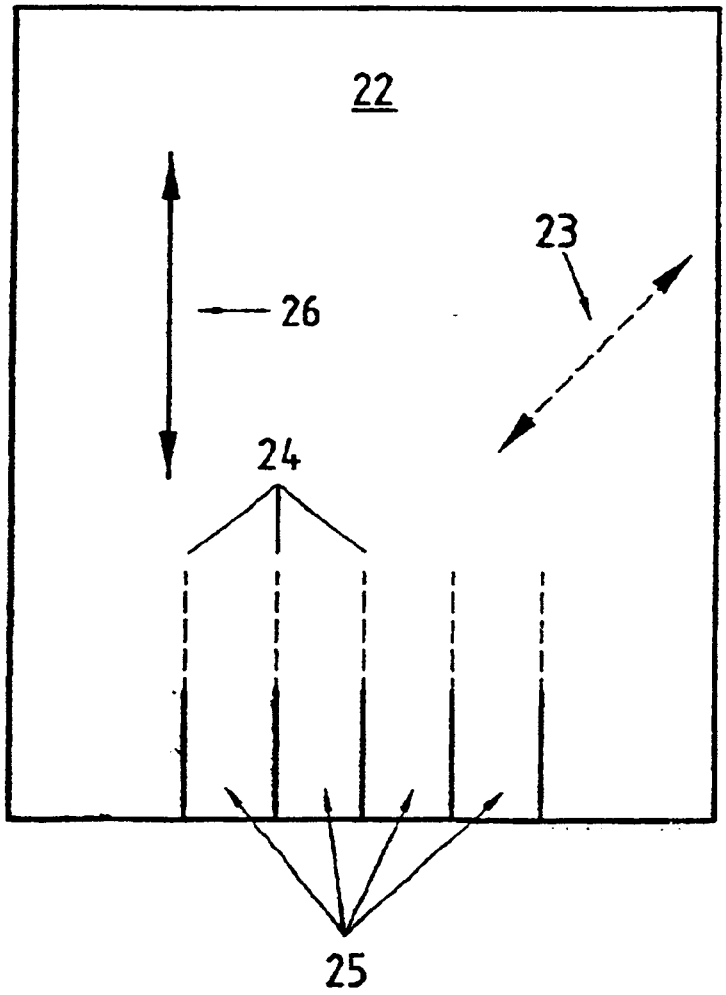

FIG. 6 the new fabric web having incisions for the production of the tapes.

EMBODIMENT OF THE PRESENT INVENTION

In FIG. 1 the method is represented schematically, for an exemplary embodiment in which two webs are used. Two original webs are used which are produced by industrial methods known per se. The two webs are laid on top of each other and their open edges are joined to each another by ultrasound, and at the same time, the seam allowances present on both sides of the webs are cut off. In this manner, a tube has been formed which is taken to a further cutting device, where it is cut open slantwise. By the slantwise cutting open, a new fabric web is formed in which the main stretching direction no longer runs along the fabric web but at an angle to the longitudinal alignment of the web. The rolled-up fabric web is cut into individual slices and made up further.

In FIGS. 2 and 3 the two fabric webs 1 and 2 are drawn more coarsely. They lie on top of each other, and are joined to each other at their open edges 3 and 4, or 5 and 6, respectively, by ultrasound, and are cut. The ultrasound device is indicated by arrows 7 and 8, as well as the pressure support 9 and 10 lying below. After edges 3, 4 or 5, 6 of webs 1, 2 are joined to one another, a tube 11 has been created.

FIG. 3 shows, in a top view, seam allowances 14, 15 of fabric webs 1 and 2 extending beyond joining lines 12, 13 created by the sealing process of the ultrasound technique at edges 3, 4 or 5, 6, respectively, which are cut off at the same time.

FIG. 4 shows the possibility of folding over a nonwoven fabric web 16 in longitudinal direction 17, and joining the open edges 18, 19 to each other. The joining process takes place in the same way as in FIG. 2, by using ultrasound device 7 and 9. Here too, the seam allowance is severed and a tube 11 is formed.

FIG. 5 shows tube 11 with cutting line 20 through wall 21. Cutting angle w of fabric web 16 is fixed at 38°.

A new fabric web 22 is created by the cutting process, in which the main alignment of the warp threads or the fibers and filaments of the nonwoven fabric web, respectively, now runs slantwise and not in the longitudinal direction of the web. This direction is indicated by arrow 23 drawn in with a dotted line in FIG. 6.

FIG. 6 shows the start of cutting lines 24 for tapes 25 which are cut from new interlining fabric web 22. Tapes 25 can be submitted to further making up steps, which are part of the related art. For example, they can be joined together with one another or with other materials by a lockstitch, chain stitch or blind stitch. Their longitudinal direction is identical to longitudinal direction 26 of new elastic fabric web 22.

| | |
|---|---|
| Zusammenlegen der Bahnen | Webs laid on top of one another |
| Verbinden der Kanten | Joining the edges |
| und | and |
| Gleichzeitiges Abschneiden der Bahnen | Simultaneous cutting off of the webs |
| Schlauchbildung | Tube formation |
| Schrägaufschnitt des Schlauches | Slantwise cutting open the tube |
| Entstehung der neuen Bahn | Creation of the new web |
| Längsschnitt der neuen Bahn | Longitudinal cut of the new web |
| Entstehung der Bänder | Creation of the tapes |

What is claimed is:

1. A method for producing elastic and stretchable tapes from a web of interlining fabric made of a nonwoven fabric web for use in the garment industry, comprising: laying at least one industrially produced web (1, 2; 16) on top of another or folding at least one web over on itself; joining the webs with one another or joining the folded web at their open edges (3, 4; 5, 6; 18, 19) so as to form a tube (11); cutting a wall (21) of the tube (11) open slantwise so that a new interlining fabric web (22) is created, which is more elastic in longitudinal direction (26) and the transverse direction and is furnished with equal strengths, and cutting the interlining fabric web in the longitudinal direction (26) to form tapes (25).

2. The method as recited in claim 1, wherein two equally wide fabric webs (1, 2) are laid one on top of the other.

3. The method as recited in claim 1, wherein a fabric web (16) is folded in half in longitudinal direction (17).

4. The method as recited in claim 1 wherein the edges (3, 4; 5, 6; 18, 19) are joined by ultrasound or a laser beam.

5. The method as recited in claim 1 wherein seam allowance (14, 15) of the fabric web (1, 2) extending beyond the joining line (12, 13) of the edges (3, 4; 5, 6) is cut off.

6. The method as recited in claim 1 wherein the cutting angle (w) of the wall (21) of the fabric web (1, 2; 16), cut open slantwise, is 8, 12 or 38°.

7. The method as recited in claim 1 wherein the cut tapes (25) are provided with a longitudinal seam using a lockstitch, chain stitch or blind stitch.

8. The method as recited in claim 1 wherein a plurality of the cut tapes (25) are joined to one another by a lockstitch, chain stitch or blind stitch.

9. The method as recited in claim 1 wherein a nonwoven fabric web (1, 2; 16) is used, having fibers or filaments which are predominantly aligned in the longitudinal direction (17) of the nonwoven fabric web (1, 2; 16).

* * * * *

UNITED STATES PATENT AND TRADEMARK OFFICE

CERTIFICATE OF CORRECTION

PATENT NO. : 6,704,979 B1
DATED : March 16, 2004
INVENTOR(S) : De Riz et al.

It is certified that error appears in the above-identified patent and that said Letters Patent is hereby corrected as shown below:

Column 4,
Line 1, insert the following caption above table:
-- Translation of Terms in FIG. 1 --.

Signed and Sealed this

Twenty-fifth Day of October, 2005

JON W. DUDAS
*Director of the United States Patent and Trademark Office*